United States Patent [19]

Dluhosch et al.

[11] Patent Number: 4,584,973

[45] Date of Patent: Apr. 29, 1986

[54] INTERNAL COMBUSTION ENGINE

[75] Inventors: Kurt Dluhosch; Fred Meister, both of Schweinfurt, Fed. Rep. of Germany

[73] Assignee: Fichtel & Sachs AG, Schweinfurt, Fed. Rep. of Germany

[21] Appl. No.: 675,769

[22] Filed: Nov. 28, 1984

[30] Foreign Application Priority Data

Dec. 5, 1983 [DE] Fed. Rep. of Germany ..... 3343876

[51] Int. Cl.[4] ..... F02B 75/24

[52] U.S. Cl. ..... 123/56 BA; 123/73 PP; 123/149 D

[58] Field of Search ..... 123/56 R, 56 AA, 56 B, 123/56 BA, 65 R, 65 PE, 65 A, 73 R, 73 A, 73 PP, 149 R, 149 A, 149 D, 599

[56] References Cited

U.S. PATENT DOCUMENTS

| | | | |
|---|---|---|---|
| 740,781 | 10/1903 | Sturtevant et al. | 123/56 AA |
| 2,339,985 | 1/1944 | Engler | 123/56 BA |
| 4,331,111 | 5/1982 | Bennett | 123/56 R X |
| 4,373,474 | 2/1983 | Schindler et al. | 123/73 PP X |
| 4,429,668 | 2/1984 | Nakagawa et al. | 123/56 B |
| 4,483,279 | 11/1984 | Köhler et al. | 123/149 D |

FOREIGN PATENT DOCUMENTS

| | | | |
|---|---|---|---|
| 0046443 | 11/1914 | Sweden | 123/56 B |
| 0121083 | 12/1918 | United Kingdom . | |
| 0851616 | 10/1960 | United Kingdom . | |
| 1155085 | 6/1969 | United Kingdom . | |
| 2009314 | 6/1979 | United Kingdom . | |

*Primary Examiner*—W. R. Wolfe

*Attorney, Agent, or Firm*—Toren, McGeady, Stanger, Goldberg & Kiel

[57] ABSTRACT

The internal combustion engine has, arranged in pairs, cylinders offset in angle in relation to one another in the direction of the axis of rotation of its crankshaft. The engine block consists of two castings, each of which combines integrally in one piece with one another one half of a crankcase, one of the cylinder housings of each pair and the cylinder heads. The castings are symmetrical in rotation at 180° in relation to an axis of symmetry lying in the plane of separation of the crankcase perpendicularly of the axis of rotation of the crankshaft, so that they can be manufactured in one and the same casting mold. The cranks for the crankshaft which are allocated to each piston pair are connected with one another through a cranked middle piece, to reduce the distance between the cylinder axes and thus to reduce vibration.

5 Claims, 3 Drawing Figures

INTERNAL COMBUSTION ENGINE

BACKGROUND OF THE INVENTION

The invention relates to an internal combustion engine, and especially an internal combustion engine having cylinders offset in angle in relation to the axis of rotation of its crankshaft. In conventional internal combustion engines of this type, to a crankcase which accommodates the crankshaft there are secured cylinder housings separate therefrom which are closed off each by a likewise separate cylinder head. The crankcase, the the cylinder housings and the cylinder heads are formed as castings. In the known internal combustion engines a separate casting mold is necessary for each of these castings, increasing the expense of manufacture. Furthermore, the castings must be fitted to one another. The threaded bolts and gaskets necessary for this purpose increase not only the expense of manufacture but also the weight of the internal combustion engine.

OBJECT OF THE INVENTION

An object of the invention is to provide a way in which the expense of manufacture and especially the weight of an internal combustion engine can be reduced.

SUMMARY OF THE INVENTION

According to the invention, there is provided an internal combustion engine comprising:

- a crankcase with a crankshaft mounted rotatably about an axis of rotation in the crankcase,
- at least one pair of cylinder housings held on the crankcase, the cylinder axes of which are offset in angle in relation to one another about the axis of rotation and which are closed on their side remote from the crankcase each by a cylinder head, and
- a piston in each of the cylinder housings, connected with the crankshaft each through a connecting rod,
- the improvements being that the crankcase is divided into two crankcase halves in a plane of separation including the axis of rotation and bisecting the angle between the cylinder axes,
- in that in each case one of the two crankcase halves, one of the cylinder housings of each pair and the cylinder head of this cylinder housing of each pair are integrally connected with one another in the form of a one-piece casting,
- and in that the two castings have cast surfaces of like form which are at 180° in rotational symmetry to one another in relation to an axis of symmetry lying in the plane of separation and perpendicular to the axis of rotation of the crankshaft.

In the case of such a configuration of the castings, the engine block of the internal combustion engine consists of only two like parts which can be cast in one and the same casting mold. The single gasket is provided in the plane of separation of the crankcase. In contrast to conventional internal combustion engines no gaskets and securing elements are necessary for the cylinder housings and the cylinder heads. The internal combustion engine according to the invention is especially light and therefore is specially suitable for use as an aircraft engine.

The internal combustion engine according to the invention is peferably a two-stroke internal combustion engine and especially an Otto engine, and the transfer passages and exhaust ports necessary for port control are provided by casting on the castings in order to minimize the subsequent machining of the castings. The supply of fresh air takes place by way of the crankcase, the halves of which in common define a suction opening lying between the two cylinder housings of the cylinder housing pair. The fuel can be injected directly into the cylinders. If the engine is formed as a carburetter engine, the carburetter is preferably secured to a suction pipe which covers the suction opening and feeds the cylinders by pairs. The suction pipe preferably also carries the elements of the ignition system, especially the ignition coil. Especially where the engine has a small number of cylinders, a magneto ignition system will be preferred, the induction magnet of which is secured on the end of the crankshaft issuing from the crankcase. The ignition system secured to the suction pipe is designed so that it extends onto the region of the path of movement of the induction magnet, so that no additional securing elements are necessary. The suction pipe is pereferably an elbow piece, so that the carburetter can be arranged on the one side transversely of the suction opening and the ignition system on the other. Thus, the dimensions of the internal combustion engine can be kept small.

Especially for use as aero-engine it is important to avoid vibrations. The rotational unbalance can be avoided in that the cylinder axes are offset by 180° in relation to the axis of rotation of the crankshaft and in that the cylinders work in synchronism, that is they are ignited at the same time and the pistons accordingly move in opposite directions. In the case of such a configuration, the cranks of the crankshaft allocated to the cylinders of each pair must be offset in the direction of the axis of rotation. Thus, the piston forces generate tilting moments acting upon the crankshaft which can lead to vibrations. In order to minimize the vibrations, the cranks of the crankshaft allocated in each case to the piston pairs are each separated from one another by a middle piece, which is cranked to reduce the interval of the cylinder axes. In order that the bearing eyes of the connecting rods may be arranged symmetrically in relation to the cylinder axes, despite the cranking of the middle piece, the rod parts of the connecting rods are offset eccentrically away from the middle piece, in relation to the bearing eyes.

The various features of novelty which characterize the inention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
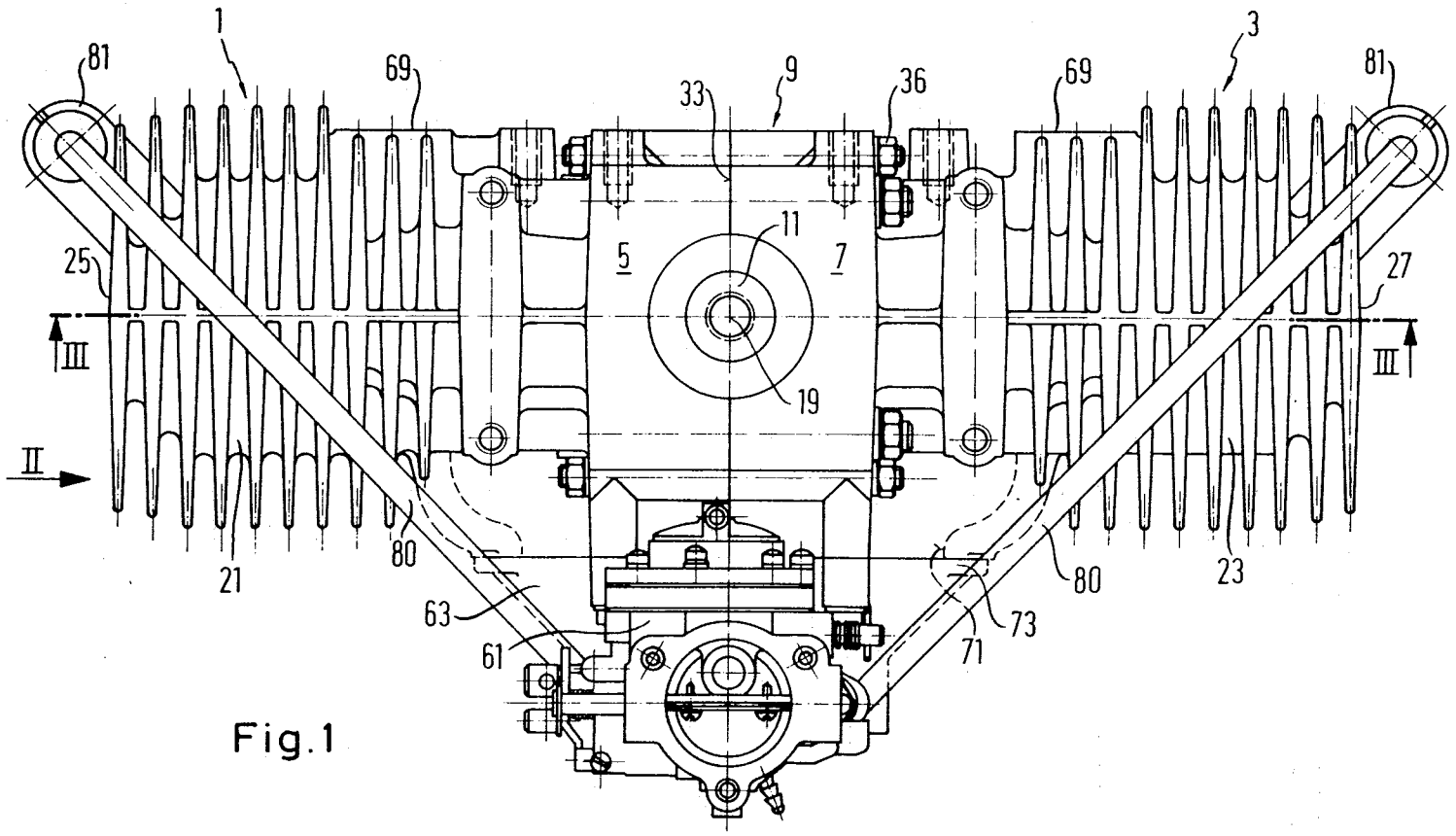
FIG. 1 shows a front view of a two-stroke internal combustion engine working according to the Otto principle, seen in the direction of the axis of rotation of its crankshaft.

The drawings show an example of a two-cylinder internal combustion engine working according to the two-stroke Otto principle, the engine block of which consists of two castings 1, 3 which are alike as regards their cast surfaces and thus can be produced in one and the same casting mold. The castings 1, 3 each include one half 5 and 7 respectively of a crankcase designated as a whole by 9, in which a crankshaft 11 is mounted for rotation about an axis 19 of rotation in bearings 13, 15, 17. From each of the crankcase halves 5, 7, a cylinder housing 21 and 23 respectively, protrudes radially of the rotation axis 19. The cylinder housings 21 and 23 carry a cylinder cover or cylinder head 25 and 27 respectively, on the side remote from the crankshaft. The cylinder axes 29, 31, represented in FIG. 3, of the cylinder housings 21, 23 intersect the rotation axis 19 and are offset in angle by 180° in relation to one another and in relation to the rotation axis 19.

The crankcase half 5, the cylinder housing 21 and the cylinder head 25 are integrally formed in one piece on the casting 1. Likewise, the casting 3 integrally forms the crankcase half 7, the cylinder housing 23 and the cylinder head 27, in one piece. The plane of division of the crankcase 9, illustrated at 33 in FIG. 1, encloses the axis 19 of rotation of the crankshaft 11 and extends perpendicularly of the cylinder axes 29, 31. The castings 1, 3, as far as the cast surfaces are concerned, are rotationally symmetrical at 180° in relation to an axis of symmetry lying in the plane 33 of separation and extending perpendicularly of the rotation axis 19. The axis of symmetry represented in FIG. 3 at 35 in the form of its trace extends in the middle between the two cylinder axes 29, 31. By reason of this configuration, the two castings 1, 3 are alike except for any finishing working, for example for adaptation to different crankshaft bearing forms, and can be cast in one and the same casting mold. Since the castings 1, 3 are one-piece castings, gaskets and threaded bolts for the securing of the cylinder housings and cylinder heads to the crankcase halves are eliminated. Only the crankcase halves 5, 7 are screwed to one another by threaded bolts 36. Only in the plane 33 of separation is there arranged a gasket (not shown further) which is thermally hardly stressed.

Figure 3:
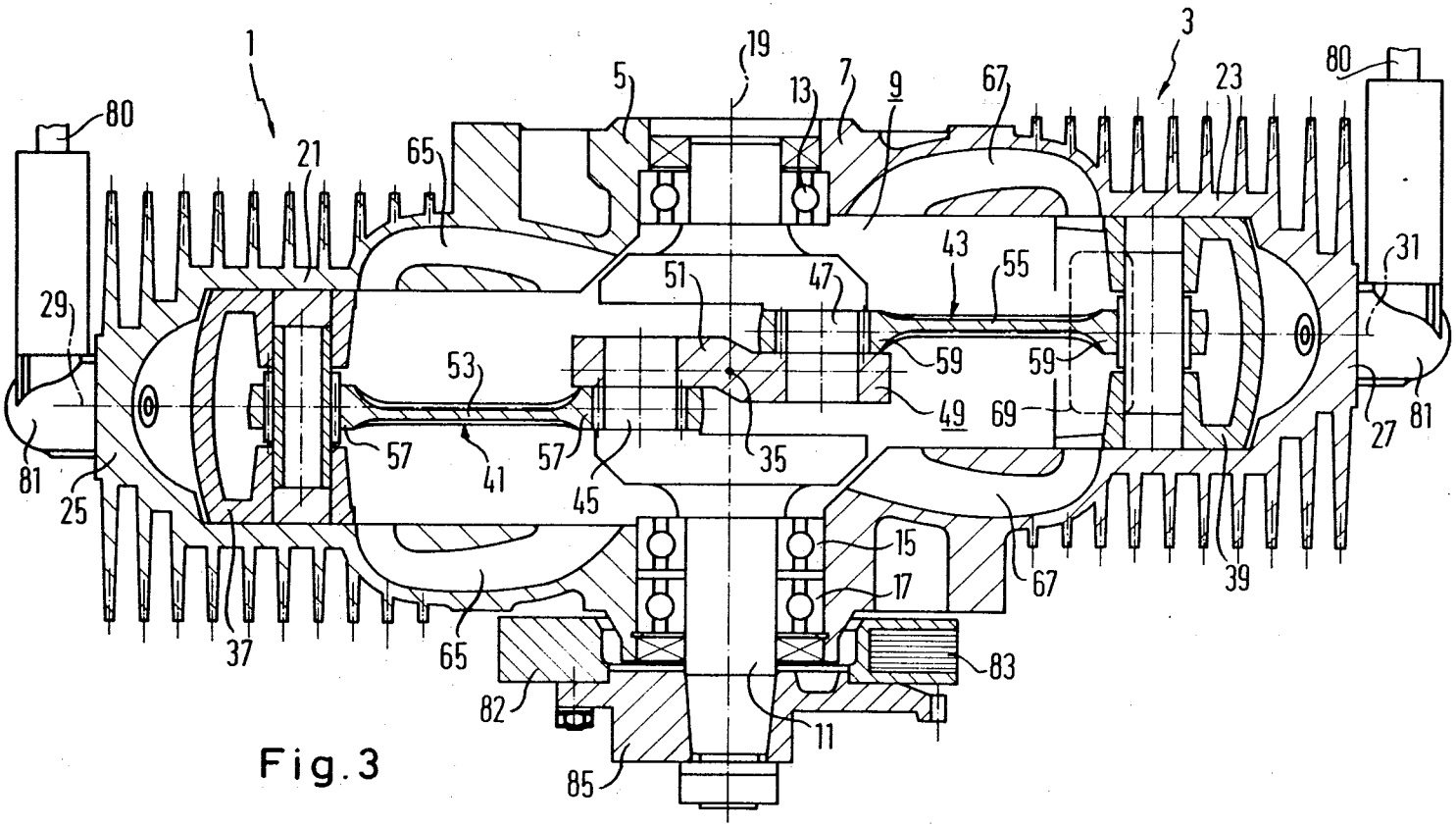
FIG. 3 shows a sectional view of the internal combustion engine, seen along a line III—III in FIG. 1.

In each of the cylinder housings 21, 23 there is arranged a piston 37 and 39 respectively, which is connected through a connecting rod 41, 43 with one of two cranks 45 and 47 of the crankshaft, which cranks are arranged side by side in the direction of the axis 19 of rotation. The cranks 45, 47 are offset in angle in relation to one another by 180° in relation to the axis 19 of rotation, so that the pistons 37, 39 move in opposite directions to compensate for the unbalance of masses. The cranks 45, 47 are connected with one another through a middle piece 49 which is cranked in its middle region 51 to reduce the distance of the cylinder axes 29, 31 from one another. Each of the connecting rods 41, 43 consists of a rod part 53 and 55 respectively, each of which carries a bearing eye 57, 59 at its ends. While the bearing eyes 57, 59 lie in each case symmetrically of a plane which includes the cylinder axes 29 and 31 and extends perpendicularly of the axis 19 of rotation of the crankshaft 11, in order to generate uniform bearing forces, the rod parts 53, 55 are offset eccentrically away from one another (FIG. 3). The offsetting provides the free movement space for the cranked middle piece 49. The cranked middle piece 49 and the eccentrically extending connecting rods 41, 43 permit proximity of the cylinder housings in the direction of the axis 19 of rotation of the crankshaft 11 and effect a reduction of vibrations.

The internal combustion engine is port-controlled by its pistons 37, 39. The fuel-air mixture is produced in a carburetter 61 and introduced by way of a suction pipe 63, bent in knee form, into the interior space of the crankcase 9. The interior of the crankcase 9 is connected by way of several transfer passages 65 and 67 according to the working cycle of the internal combustion engine with the combustion chambers defined between the piston 37 and 39 respectively, and the cylinder head 25 and 27 respectively. Exhaust ports are provided for each of these combustion chambers, and one of them is represented at 69. The transfer passages 65, 67 and the exhaust ports 69 are controlled by the pistons 37 and 39 in the conventional way.

The suction pipe 63 covers over a suction opening 71 (FIG. 1) which is cast, as part of the suction path, to the crankcase halves 5, 7. For securing to the suction conduit part of the crankcase 9, the suction pipe 63 carries a flange 73 at its one end. The carburetter 61 is flanged to the other end of the suction pipe 63.

Figure 2:
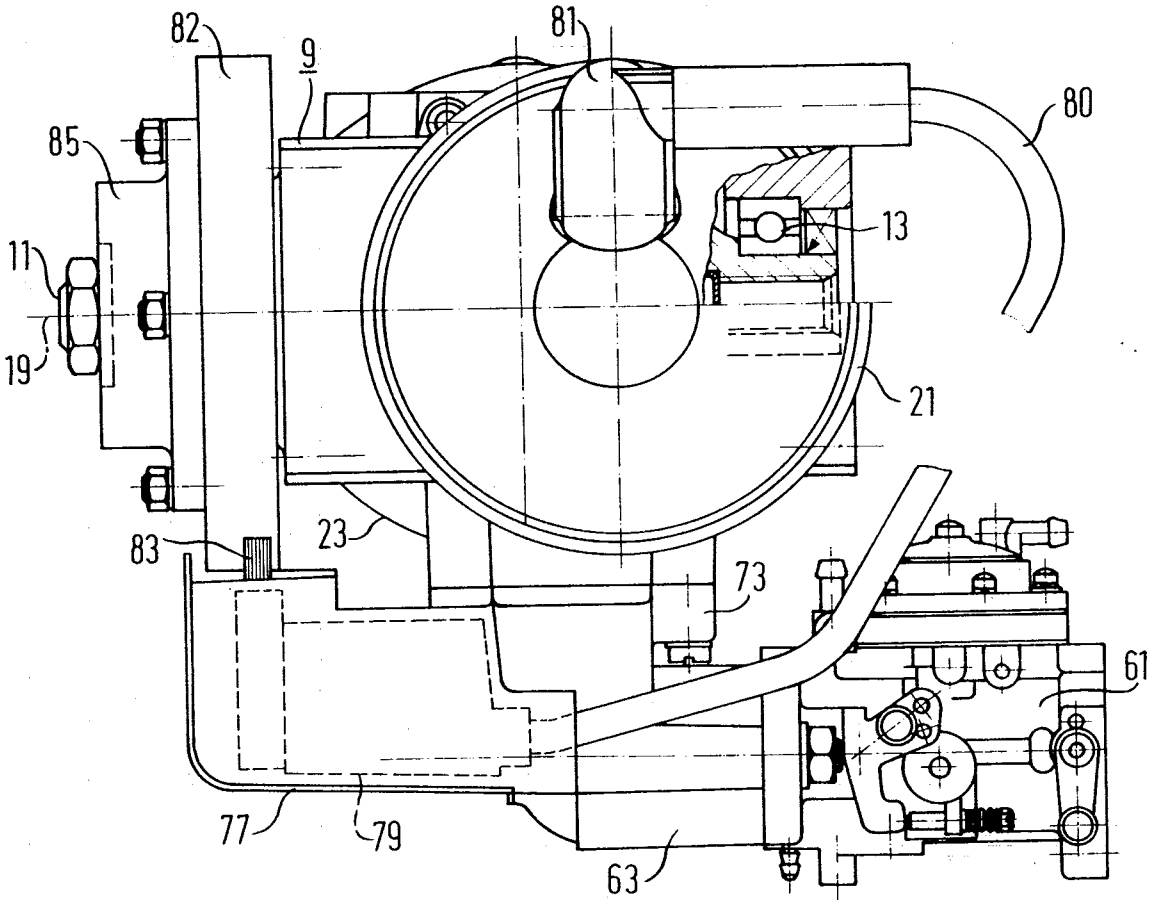
FIG. 2 shows a side view of the internal combustion engine, seen in the direction of an arrow II in FIG. 1.

The suction opening 71 extends transversely of the crankshaft 11, which emerges at its left end in FIG. 2 from the crankcase 9. The suction pipe 63 is angled oppositely to this end and carries on its side adjacent to the drive-output end of the crankshaft 11, the main components of a magneto ignition system 77, especially its ignition coil 79 which is connected by ignition cables 80 and spark plug caps 81 with spark plugs (not illustrated further). On the drive-output end of the crankshaft 11 there is secured a disc 82 which carries an induction magnet 83 which induces the ignition pulses in the ignition coil or an induction coil separate therefrom.

The internal combustion engine as described above will be utilized for preference as an aero-engine. Accordingly, the drive-output end of the crankshaft 11 carries a securing flange 85 for a propeller. However, the internal combustion engine can also be used for other drive purposes. It is distinguished by low production expense, low weight and low vibrations.

While specific embodiments of the invention have been shown and described in detail to illusrate the application of the inventive principles, it will be understood that the invention may be embodied otherwise without departing from such principles.

We claim:

1. An internal combustion engine comprising:

(a) a crankcase, (b) a crankshaft mounted within said crankcase for rotation about an axis of rotation, (c) at least one pair of cylinder housings mounted on the crankcase, the cylinder axes of which are offset in angle in relation to one another about the axis of rotation, (d) cylinder heads which close the cylinder housings on their sides remote from the crankcase, (e) a piston in each of the cylinder housings, and (f) connecting rods connecting the pistons with the crankshaft, the improvement being that (g) the crankcase is divided into two crankcase halves in a plane of separation which includes the axis of rotation and bisects the angle between the cylinder axes, (h) in each case one of the two crankcase halves, one of the cylinder housings of each pair and the cylinder head of this cylinder housing of each pair are integrally connected with one another in the form of a one-piece casting, and (i) that the two castings have cast surfaces or like form which are at 180° in rotational symmetry to one another in relation to an axis of symmetry lying in the plane of separation and perpendicular to the axis of rotation of the crankshaft, (j) the crankshaft comprises between two crankshaft bearings, two adjacent cranks interconnected by a middle piece, for each pair of pistons, the middle piece being cranked to reduce the distance between the cylinder axes of the cylinder housings of the piston pair, (k) and the connecting rods of each piston pair comprise between their bearing eyes, rod parts eccentrically offset away from the middle piece, in relation to the bearing eyes.

2. An internal combustion engine according to claim 1, operating as a two-stroke engine having two cylinder housings offset by 180° in relation to one another, in relation to the axis of rotation of the crankshaft.

3. An internal combustion engine comprising:

(a) a crankcase, (b) a crankshaft mounted within said crankcase for rotation about an axis of rotation, (c) at least one pair of cylinder housings mounted on the crankcase, the cylinder axes of which are offset in angle in relation to one another about the axis of rotation, (d) cylinder heads which close the cylinder housings on their sides remote from the crankcase, (e) a piston in each of the cylinder housings, and (f) connecting rods connecting the pistons with the crankshaft, the improvement being that (g) the crankcase is divided into two crankcase halves in a plane of separation which includes the axis of rotation and bisects the angle between the cylinder axes, (h) in each case one of the two crankcase halves, one of the cylinder housings of each pair and the cylinder head of this cylinder housing of each pair are integrally connected with one another in the form of a one-piece casting, and (i) that the two castings have cast surfaces of like form which are at 180° in rotational symmetry to one another in relation to an axis of symmetry lying in the plane of separation and perpendicular to the axis of rotation of the crankshaft, (j) operating in a two-stroke cycle wherein the crankcase halves in common define a suction opening lying between the two cylinder housings of the pair, each cylinder housing having at least one transfer passage controlled by the piston and at least one exhaust port, (k) a suction pipe covering over the suction opening is secured on the castings, wherein a magneto ignition system including at least one ignition coil is mounted on the suction pipe and wherein at least one induction magnet of the magneto ignition system is secured on the end of the crankshaft issuing from the crankcase.

4. An internal combustion engine according to claim 3, wherein a suction pipe covering over the suction opening is secured on the castings and wherein a carburetter is secured to the suction pipe.

5. An internal combustion engine according to claim 3, operating as a two-stroke engine having two cylinder housings offset by 180° in relation to one another, in relation to the axis of rotation of the crankshaft.

* * * * *